US007418911B2

(12) United States Patent
McClintock

(10) Patent No.: US 7,418,911 B2
(45) Date of Patent: Sep. 2, 2008

(54) TRAILERABLE SAILBOAT WITH MAST RAISING METHOD

(76) Inventor: Scott G. McClintock, 1911 E. Bruce Ave., Gilbert, AZ (US) 85234

( * ) Notice: Subject to any disclaimer, the term of this patent is extended or adjusted under 35 U.S.C. 154(b) by 0 days.

(21) Appl. No.: 11/550,576

(22) Filed: Oct. 18, 2006

(65) Prior Publication Data

US 2008/0141918 A1 Jun. 19, 2008

(51) Int. Cl.

| | |
|---|---|
| ***B63B 15/00*** | (2006.01) |
| ***B63H 9/10*** | (2006.01) |
| *B60P 3/10* | (2006.01) |
| *B60P 3/071* | (2006.01) |
| *B62D 63/00* | (2006.01) |

(52) U.S. Cl. ..... 114/90; 114/89; 114/97; 280/414.1; 280/414.2

(58) Field of Classification Search ..... 114/89–101, 114/102.1, 102.29; 280/414.1, 414.2
See application file for complete search history.

(56) References Cited

U.S. PATENT DOCUMENTS

| | | | | |
|---|---|---|---|---|
| 4,448,143 | A * | 5/1984 | Welsh | 114/90 |
| 4,624,204 | A | 11/1986 | Temple | |
| 4,655,154 | A | 4/1987 | Leonard | |
| 4,718,370 | A | 1/1988 | Portell-Vila | |
| 4,935,295 | A | 6/1990 | Serafini | |
| 5,044,410 | A | 9/1991 | Mix | |
| 5,865,136 | A | 2/1999 | Alexander | |
| 6,526,901 | B2 | 3/2003 | Iacoboni | |
| 6,990,916 | B1 | 1/2006 | Atwood, Jr. | |

FOREIGN PATENT DOCUMENTS

| | | | |
|---|---|---|---|
| DE | 29912423 | U1 * | 11/1999 |
| WO | WO 8702322 | | 4/1987 |

* cited by examiner

*Primary Examiner*—Lars A Olson
*Assistant Examiner*—Daniel V Venne

(57) ABSTRACT

Important design features and methods of launching a trailerable sailboat are described. The trailerable sailboat is designed to allow transportation on overland highways and to provide a simplified method of raising the mast without the need for a crane.

10 Claims, 6 Drawing Sheets

TRAILERABLE SAILBOAT WITH MAST RAISING METHOD

CROSS REFERENCE TO RELATED APPLICATIONS

Not applicable.

STATEMENT REGARDING FEDERALLY SPONSORED RESEARH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

This invention is directed toward trailerable sailboats in general and also to larger trailerable sailboats that can be transported over the public highway systems throughout the United States. Important features and methods are described which allow a sailboat to be trailerable with special considerations for convenience, operational simplicity, transportation, and expense.

(2) Description of Related Art

Historically, sailboats have provided important transportation and have more recently evolved into a significant recreation activity. As part of convenience, sailboats are commonly transported to desirable sailing locations on trailers over the US public roadway system. The trailer is used to launch the sailboat or a special crane is used to lift the boat into the water. Because sailboats always have a high sailing mast, the mast must be stored so the trailered boat will pass under bridges and fit with the US highway transportation specifications for dimensions and weight. How the mast is lowered, raised, and stored on a trailer becomes an important practical issue.

It is a distinct advantage to transport a sailboat on a trailer from the water to dry storage. This eliminates the need for an in water slip, which has the advantage of reducing cost to the owner for storage and handling. Being stored away from the harsh in-water environment also has the advantage of reducing maintenance expenses to the owner by reducing corrosion, fouling, mildew, organic growth, power use, and wear. Land storage of boats also has the advantage of releasing fewer toxins and other man made compounds into the water.

Others have considered the difficulties in raising and lowering a mast, including one that pivots. For example, U.S. Pat. Nos. 6,990,916, 6,526,901, 5,865,136, 4,718,370, and 4,624,204 all disclose various methods whereby a mast is raised and lowered. In these cases additional supporting structures, complicated mechanisms, or rigging that is not required for sailing the boat are needed to raise and lower the mast. The additional structures add weight, time, complexity, and expense to the boat operation.

A typical example of a mast raising system for a mast that pivots is U.S. Pat. No. 6,990,916 which discloses a mast stepping system with a vertical pole. The mechanism used to raise the mast is overly complicated and requires an operator to install the raising equipment. The mast support structure takes up a lot of deck space and has to be carried to, or stored on, the boat. It is very awkward for an operator to use.

Similarly, U.S. Pat. No. 5,865,136 discloses a portable crane with a winch and rigging that provides lifting force for a pivoting mast. However, the lifting mechanism is not required for sailing and must be installed and removed at each launching. The rail system described would need to be very heavy to contain the lifting and stability forces required making it unappealing for an operator to actually use.

U.S. Pat. No. 5,044,410 discloses a latching mechanism for a mast that pivots. However, no consideration is given to an easy method of raising the mast, in particular, for a mast that is too heavy for one operator to manually lift.

U.S. Pat. No. 4,934,295 discloses an unconventional A-shaped mast that is pivotally connected to the sailboat. The mast can be raised or lowered manually. However, as in other patents just described, no consideration is given to a simple method of raising the mast, in particular, for a mast that is too heavy for one operator to manually lift.

PCT publication number WO87002322 discloses a sailing boat with a separate 'boom,' which is more accurately described as an A-frame gin pole, that is added to the sailboat to aid in raising and lowering the mast. The so called boom is not actually used for sailing, and if placed aft of the main mast, would have to be removed for sailing. In actual use, this disclosure has serious practical limitations. The mast is prevented from tipping toward starboard or port by shrouds, or rigging. The tension in these lines must be continually adjusted when the mast is raised or lowered; otherwise even a light wind will place excessive torsion on the mast base. Another source of torsion may come from the boat being moderately tipped, such as may occur when the trailer is on a sloped surface. This is awkward and impractical and makes it difficult for a single operator to raise or lower the mast. A suggested spring adjustment is not well thought out and is illustrated non-symmetrically, without a practical explanation on how it would operate or be controlled. Finally, there are no descriptions of how the pivot points of the mast or boom should be designed to withstand any inadvertent twisting forces that will be likely be applied to the mast or boom in the raising operation.

U.S. Pat. No. 4,655,154 discloses a collapsible mast assembly for a sailboat that includes a deck mounted mast support. A pivoting mast is described but the patent does not disclose an easy method of raising the mast, in particular, for a mast that is too heavy for one operator to manually lift. The boom does not move the mast as the mast is folded over on top of the boom in the stored position.

On a conventional sailboat, the boom is mounted to the mast, above the mast base, on a universal joint. It is not practically possible to use the boom as a lever in raising the mast. The boom is unstable due to the freedom of motion provided by the universal joint.

Historically, and currently, trailerable sailboats are generally limited to sailboats having lengths of less than approximately thirty feet due to excessive width and weight of the boat, and due to the weight and complexity of the sailing rig in larger boats. The design of these relatively shorter boats does not consider important difficulties that arise in larger sailboats. Sailboats longer than approximately thirty feet, designed to customary industry proportions, have widths, drafts, or weights that exceed practical maximums for private trailers on most highways. Consequently, trailer, rigging, and launching challenges rise disproportionately as sailboats become longer than approximately thirty feet. Also, longer sailboats require special permits and/or commercial carriers for transport over land, due to their overall dimensions, and especially due to their width. These larger sailboats require substantial disassembly for transport requiring a crane to remove and position the mast.

Sailboats of the previously described patents often use hinged mast raising and lowering techniques suitable only for a smaller sailboat where the mast weight is about 25 pounds or less. When a mast is heavier than this, special tools, rigging, or mechanical leverage have become needed for a single operator to safely lift and install the mast.

A number of the previous trailerable sailboats utilize a mast that is completely removed from the sailboat and then stored horizontally on top of the sailboat during overland transport. Special mast supports are then used. This design is undesirable as modern masts for larger boats include numerous important rigging lines and electrical wiring to equipment used for sailing that must be disconnected. Also, longer trailerable sailboats have a commensurately heavier mast which makes the method of completely removing the mast from the sailboat highly undesirable. The storage of a heavy mast in this manner is very unappealing to an operator, requires a lot of time and care, makes an operator vulnerable to injury, and is likely to damage the sailboat. Sailboat operators are primarily interested in the amount of time in the water and not the amount of time needed for various preparations.

Longer, trailerable sailboats have a number of design problems that require a complete design encompassing important details due to the length and weight of the sailboat. The essential problems not previously considered as a whole are: the mast must be raised and lowered in a controlled and easy method, the overall dimensions must fit within normal overland transport requirements, and the position on a trailer must include considerations for the longer and heavier mast. The design must also consider that it is desirable to launch a sailboat within 10 to 15 minutes after arriving at a boat launch without use of a crane or other external equipment in typical weather conditions. It is especially desirable to launch the boat with only one operator. Further, it is also desired that existing equipment on the sailboat is used to the extent possible to accomplish these important functions.

BRIEF SUMMARY OF THE INVENTION

Important details that provide for a trailerable sailboat are disclosed. In particular, important design details are revealed that include consideration for raising and lowering the mast by using a stabilized boom and a special mast rigging arrangement. The design includes important operational features related to the boom and mast. Also, important details about how the sailboat may be situated on a gooseneck trailer are included.

BRIEF DESCRIPTION OF THE SEVERAL VIEWS OF THE DRAWING(S)

FIGS. 1, 2, 3A, and 3B show the method of raising the mast utilizing the boom.

DETAILED DESCRIPTION OF THE INVENTION

The present invention relates to trailerable sailboats and specifically to larger trailerable sailboats with lengths that would customarily be limited to commercial trailers.

An important embodiment of the present invention is to provide for a large trailerable sailboat with dimensions suitable for hauling on the US highway system without the need for a special permit. Currently, a boat length less than forty-five feet as measured from the bow tip to end of the stern and a maximum width of eight and a half feet, will not require a special hauling permit on most US roadways.

Features of the present invention are a useful advantage for trailerable sailboats with a displacement that allows transport behind a non-commercial truck. For example, the displacement of trailerable sailboats may be approximately 13,000 pounds or less, which enables towing behind a non-commercial truck.

It is desirable to provide a large trailerable sailboat as it will generally have better performance. A larger sailboat will have greater speed potential, a more comfortable ride, greater safety, better accommodations, and is therefore highly preferable.

It is also desirable to provide a sailboat with features that simplify the launching of the boat from a variety of docks and boat landings. In particular, longer sailboats have masts that are excessively heavy and complex normally requiring a lifting crane. Masts greater than about 25 pounds become difficult for an operator to raise without a crane or additional lifting mechanisms. The sailing masts of large trailerable sailboats have greater forces to accommodate as the sail height and sail area have become very large. These masts may weigh as much as 100 to 200 pounds.

It is highly desirable to provide for raising a heavy mast with as simple a method as possible. The mast must be lowered in order to allow practical overland transport. The present invention carefully considers this important problem from a variety of factors and provides for an elegant, simple, and practical solution. The factors involved with solving this problem include convenience, safety, stability, use of existing equipment, timeliness, and weight.

The foregoing and other features and advantages of the present invention will be apparent from the following more detailed description of the particular embodiments of the invention, as illustrated in the accompanying drawings.

Figure 1:
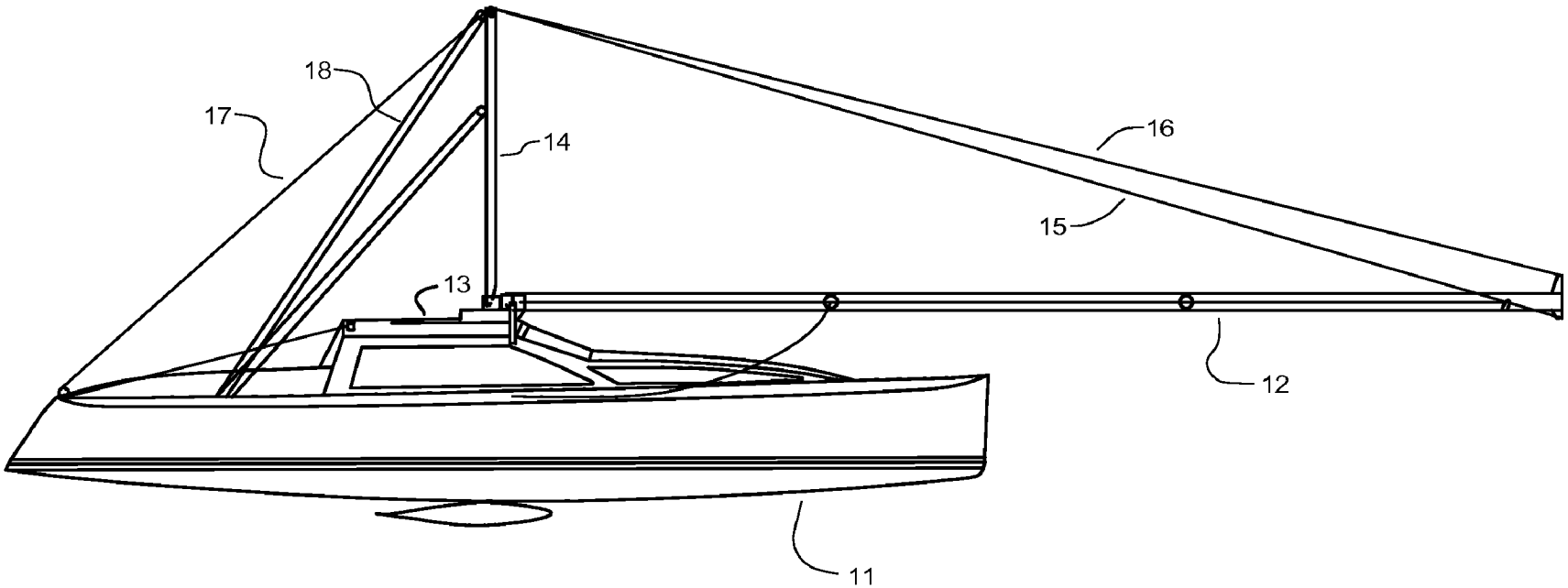

In FIG. 1, a larger trailerable sailboat 11 is shown. The mast 12 is attached to the top of the cabin 13 in a manner to allow the mast 12 to pivot upright to its vertical position. The mast end axis of rotation is substantially horizontal in reference to the sailboat as it would sit on a trailer, and projects outwardly from FIG. 1. To prepare to raise the mast 12, the boom 14 is raised to the vertical position manually with the spinnaker halyard 15, main halyard 16, spinnaker sheet 17, and main sheet 18 lines attached to the boom 14 end. The axis of rotation of the boom 14 also projects outwardly from FIG. 1.

Figure 2:
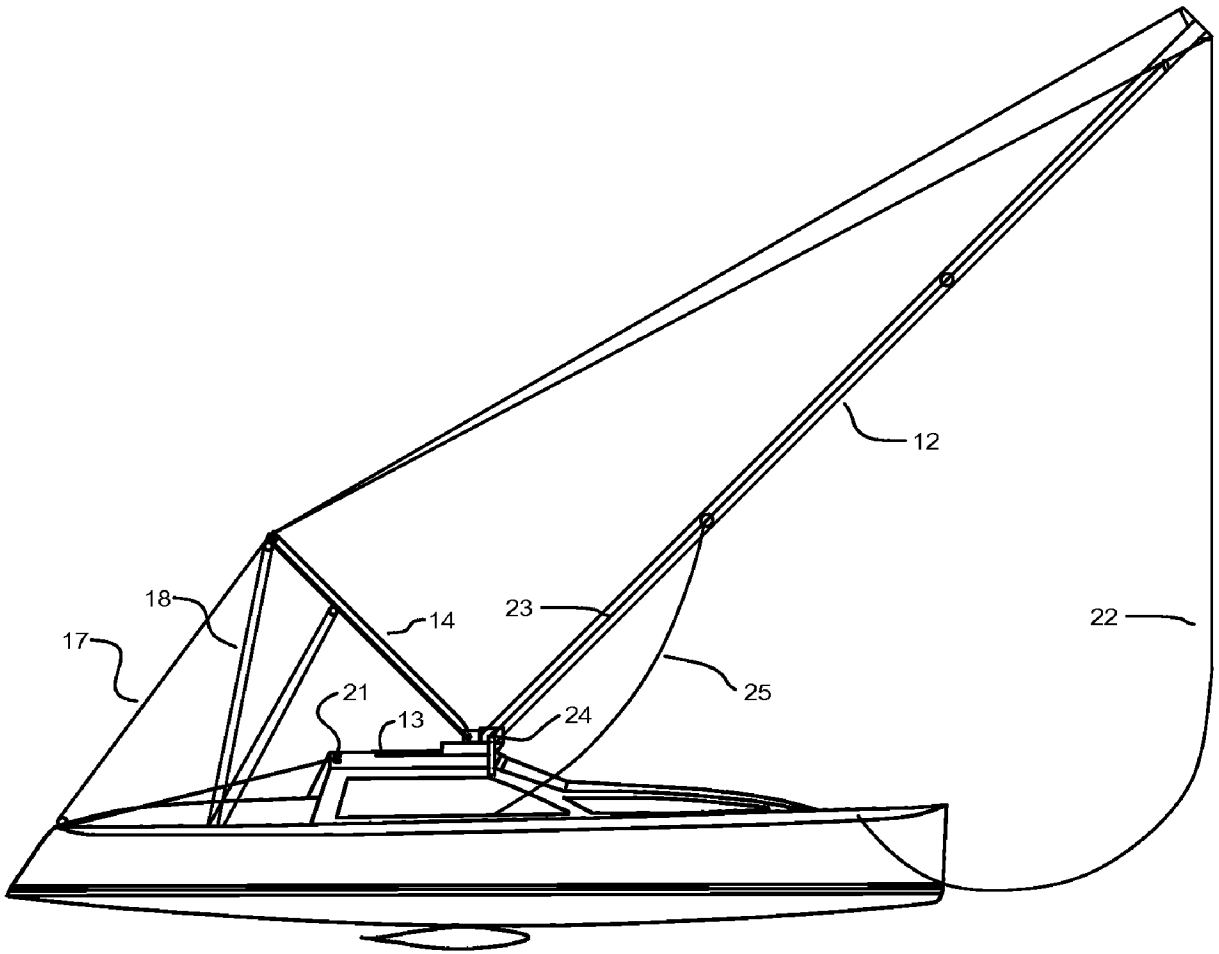

In FIG. 2, the mast 12 is shown in the partially raised position. To raise the mast 12, the spinnaker sheet 17 and main sheet 18 lines are used to pull the free end of the boom 14 downward toward the stem. The spinnaker sheet 17 is pulled by use of a winch 21 which may be conveniently located on top of the cabin 13. Alternately and equally, a block and tackle system or other mechanical advantage system could be used. The elevated boom 14 will provide a good leverage angle which will lower the needed force in the spinnaker sheet 17 line to raise the mast 12. A forestay 22 is attached to the top of the mast 12 and will tension once the mast 12 is vertical. The lower shroud 23 lines are tensioned to the mast 12 to provide lateral stability and keep the mast 12 in the plane of FIG. 2. The lower shroud 23 lines are connected to termination points 24 (starboard side only shown) which are inline with the rotational axis of the mast end rotational axis. The other mast rigging shroud lines 25 will tension once the mast 12 is vertical.

Figure 3A:
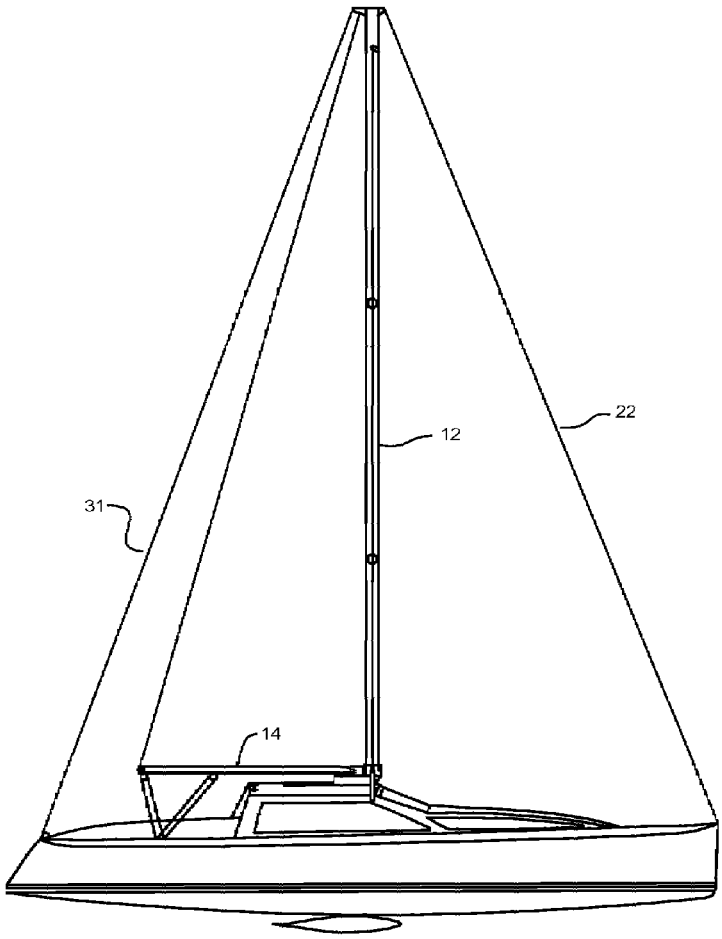
Figure 3B:
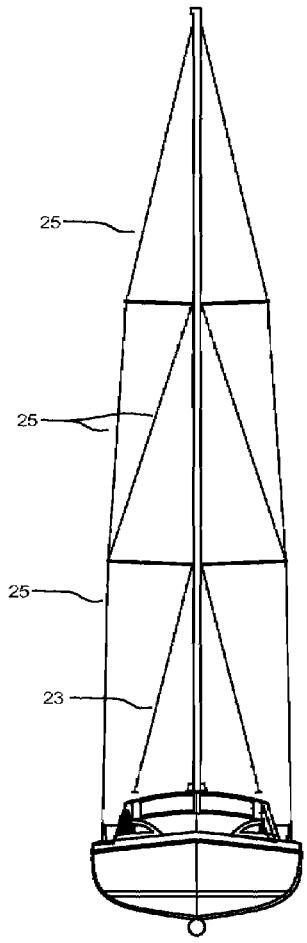

In FIG. 3A, once the mast 12 reaches its full upright position, the backstay 31 is pinned and the forestay 22 is tensioned properly for sailing. The boom 14 is then used for normal sailing purposes. The lower shroud lines 23 and other mast rigging shrouds 25 are shown more clearly in FIG. 3B.

With longer masts, the weight requires that the mast is stabilized laterally while being raised, and is only allowed to rotate in a single plane about the pivoting end. Trailerable sailboats of the past have required both standing rigging for sailing, and a non-sailing rigging for raising and lowering the mast. This added complexity creates longer launching times. Besides this, the non-sailing rigging typically used with past trailerable sailboats must be removed or stowed for sailing. On the other hand, the sailboat of the present invention advantageously uses the standing rigging for both sailing and for stabilizing the mast during raising and lowering of the mast. The lower shroud lines of the present invention terminate at a point in line with the pivoting axis of the mast end. This has distinct advantages of maintaining line tension, and therefore a stabilized mast, without the need for adjustment while the mast is being raised or lowered.

An important embodiment of the present invention connects the mast to the highest portion of the cabin. The overall mast length is thereby shortened with the effect of reducing the overall length of the sailboat when placed on a trailer. This provides for a mast that does not excessively protrude beyond the end of the gooseneck trailer when the mast is positioned for overland travel.

Another important object of this invention is providing for an elegant method of raising and lowering the mast utilizing existing equipment to the extent possible, and without the need for a lifting crane.

The methods of the present invention are a distinct advantage for larger trailerable sailboats with a displacement less than 13,000 pounds and a mast weighing more than about 25 pounds.

The methods of the present invention are a distinct advantage for larger trailerable sailboats where the large trailerable sailboat is hauled on a goose neck trailer. The hauling method preferably includes providing for the use of a standard, readily available pick-up truck. As another embodiment of the invention, the overall hauling length including the sailboat and truck is up to 65 feet in length. Currently, the maximum length for such a combination during transport without a permit for most major highways is 65 feet. Thus, it can be seen that lengths of sailboats in accordance with the teachings of the present invention may be maximized.

It is to be understood that additional measures may be taken to maximize sailboat length. For example, the towing vehicle may be replaced by a cabover in order to move a gooseneck hitch position as far forward as possible. Alternatively, the sailboat may be located positioned on the trailer so that the bow is at the rear of the trailer and the mast is tipped so that it extends forward toward the trailer hitch point. In this way, a different mast position on the deck may be provided. In this case, the trailer structure could be modified to more completely fill the gap between the trailer and a rear of the towing vehicle if needed. Thus, the extra length of an even longer sailboat could be accommodated in this gap.

The methods of the present invention are a distinct advantage for larger trailerable sailboats where the sailboat launching may be performed within a period of time of approximately twenty minutes or less. In a preferred embodiment, the period of time is ten minutes or less. The steps of launching the sailboat preferably include rigging and launching without a crane or hoist. Further, the steps of launching and rigging the sailboat are optionally done by a single individual. However, and equally, additional people may help in rigging and launching for redundancy and improved safety.

In actual practice, the mast raising mechanisms and method shown in the drawings and described herein enables a large, heavy mast to be rigged in about ten minutes without special equipment. This time requirement is short compared to thirty to forty minutes typically required for rigging most other current trailerable sailboats. When a drop keel and retractable rudder are used, the sailboat draft is advantageously reduced from approximately seven feet for sailing to approximately two feet, enabling traditional ramp launching.

Figure 4:
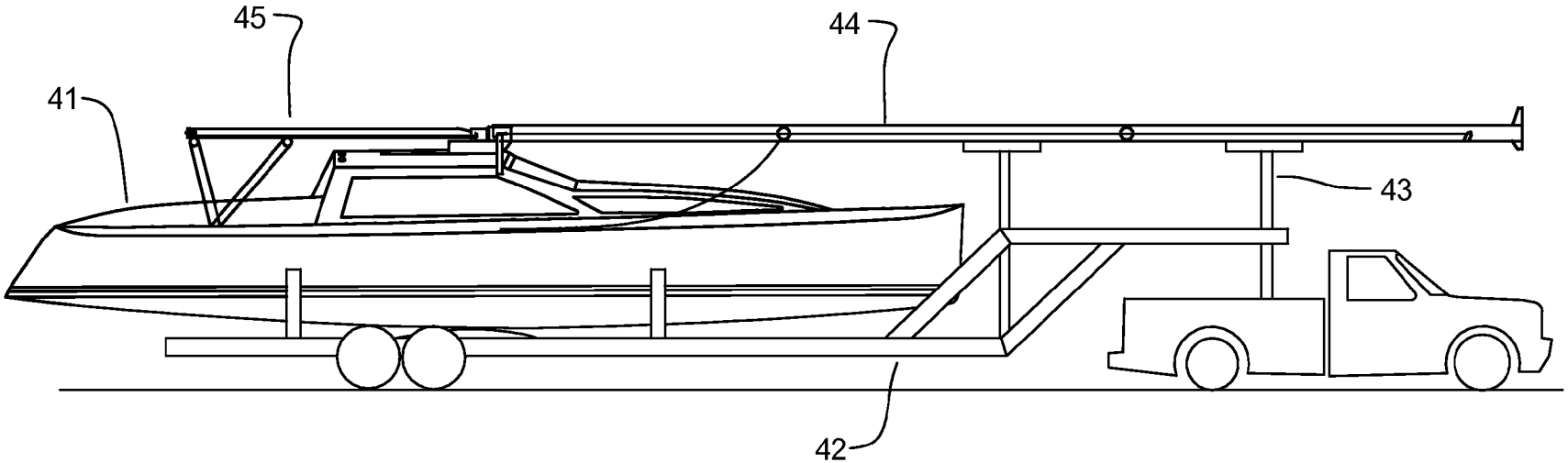
FIG. 4 shows how the boat sits on a goose neck trailer and how the mast is supported.

FIG. 4 shows how the large trailerable sailboat 41 may be located on a gooseneck trailer 42. The use of a gooseneck trailer 42 is a preferred embodiment as the trailer to vehicle hitch point is further forward. This will reduce the mast overhang beyond the hitch connection to a practical length which may be approximately 12 feet. This is an advantageous embodiment of the present invention since the vast majority of trailered sailboats are towed from bumper mounted hitches. Positioning the trailer to vehicle hitch point further forward as shown is advantageous over the standard bumper hitch location because it reduces a lateral sweep of the mast during turns. Thus, the mast will be more manageable when traveling and is less likely to strike objects that are positioned at an outer radius of the turn. Therefore, locating the mast connection point as described herein and utilizing a gooseneck trailer in combination advantageously provide the needed reduction in forward overhang and a radial extent of the sweep of the mast. It is a distinct advantage not to remove the mast for transport.

As shown in FIG. 4, the gooseneck trailer 42 may also include one or more mast supports 43 for stabilizing the mast 44 in its lowered forward position. An additional advantage of using a pivoting mast is that an operator may leave sailing rigging attached except for a backstay.

As shown in FIG. 4, the boom 45 is lowered and secured to the deck for trailering and transport.

A drop keel is also raised for transport. Although drop keels are known, a drop keel of the present invention may weigh as much as 6,000 pounds. When the large trailerable sailboats of the present invention are in use, the drop keel of the present invention may enable a much smaller draft when the drop keel is raised as compared to sailboats of comparable length.

The method of the present invention, including practical owner towing, rigging and launching for larger trailerable sailboats, appears not to have been taught before. Furthermore, larger sailboats may be provided to previously unavailable waters without completely sacrificing accommodations for longer cruises. Thus, the present invention enables moderately comfortable accommodations without compromising performance. For example, amenities needed for comfortable travel during cruises of weeks may be provided.

Figure 5B:
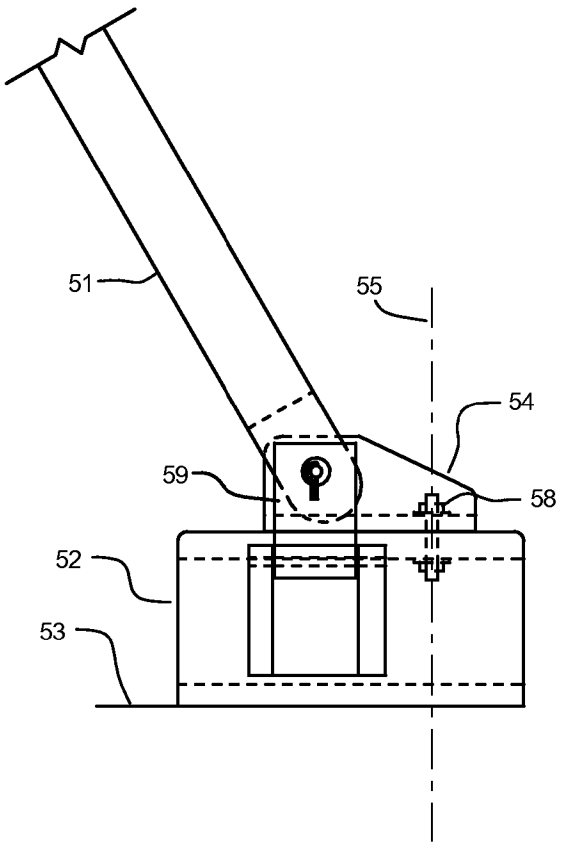
FIGS. 5A and 5B show important stabilizing details of the boom and how it may be attached to the cabin top.
Figure 5A:
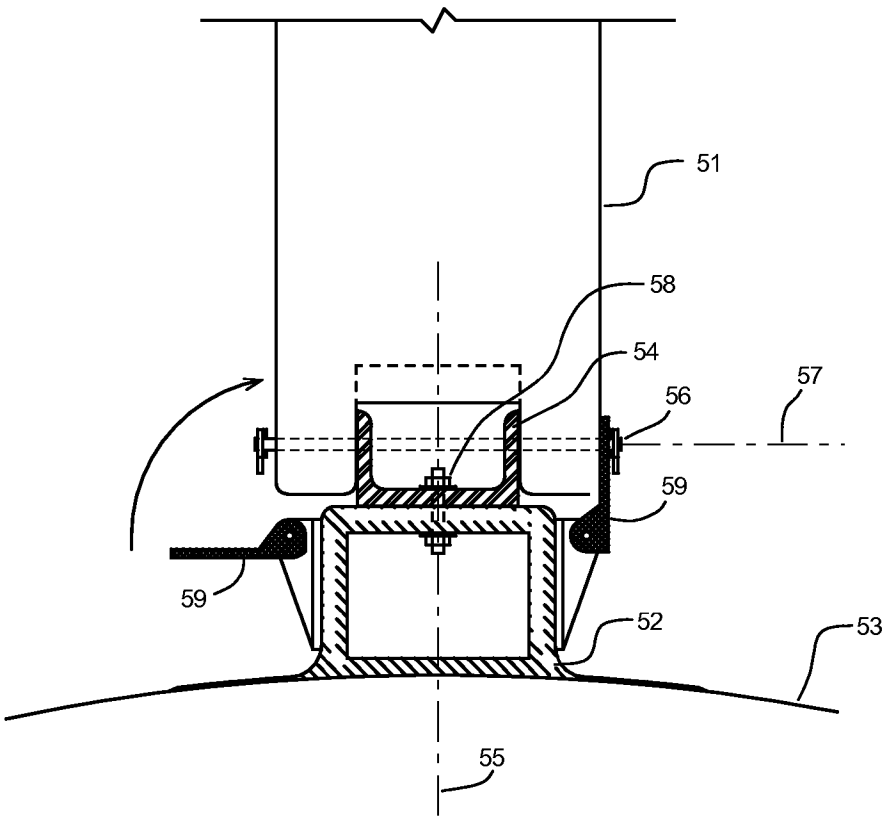

FIG. 5A shows a cross section of a preferred method for attaching the boom 51 to the top of the cabin. The boom 51 is connected to a goose neck supporting structure 52 which is laminated to the top of the cabin roof 53. A goose neck 54 is loosely bolted to the goose neck supporting structure 52 so that the goose neck 54 pivots about the goose neck vertical axis 55. This pivoting vertical axis is the normal axis used for sailing and allows the boom 51 to pivot port to starboard. The boom 51 is attached to the goose neck 54 by a shaft 56 which allows the boom 51 to pivot vertically about the boom horizontal axis 57.

There is significant torsion that may be applied to the shaft 56 when the main mast is initially raised to vertical. This torsion may come from a poorly controlled mast, especially if the lower shrouds are in poor adjustment or if there is a wind blowing. During this operation, the boom 51 should be stabilized so that it will not rotate about the vertical axis 55 and will only rotate about the horizontal axis 57. Stabilizing clamps 59 are rotated to the position as shown on the right side and firmly hold the shaft 56 to the goose neck support structure 52. The clamp 59 on the left side is shown partially rotated. The clamps 59 will resist any force that tends to rotate or tilt the boom toward starboard or port and provide important, redundant control of the boom during the procedure for raising the mast. The clamps 59 can then be rotated away from the shaft 56 to allow normal boom 51 sailing movements.

The goose neck 54 illustrated in FIG. 5A and 5B is only one possible method of attaching the boom 51 to the goose neck support structure 52. Other mechanical arrangements could be used that incorporate a vertical and horizontal axis of rotation for the boom end.

FIG. 5B shows a side view of the arrangement of FIG. 5A.

Figure 6:
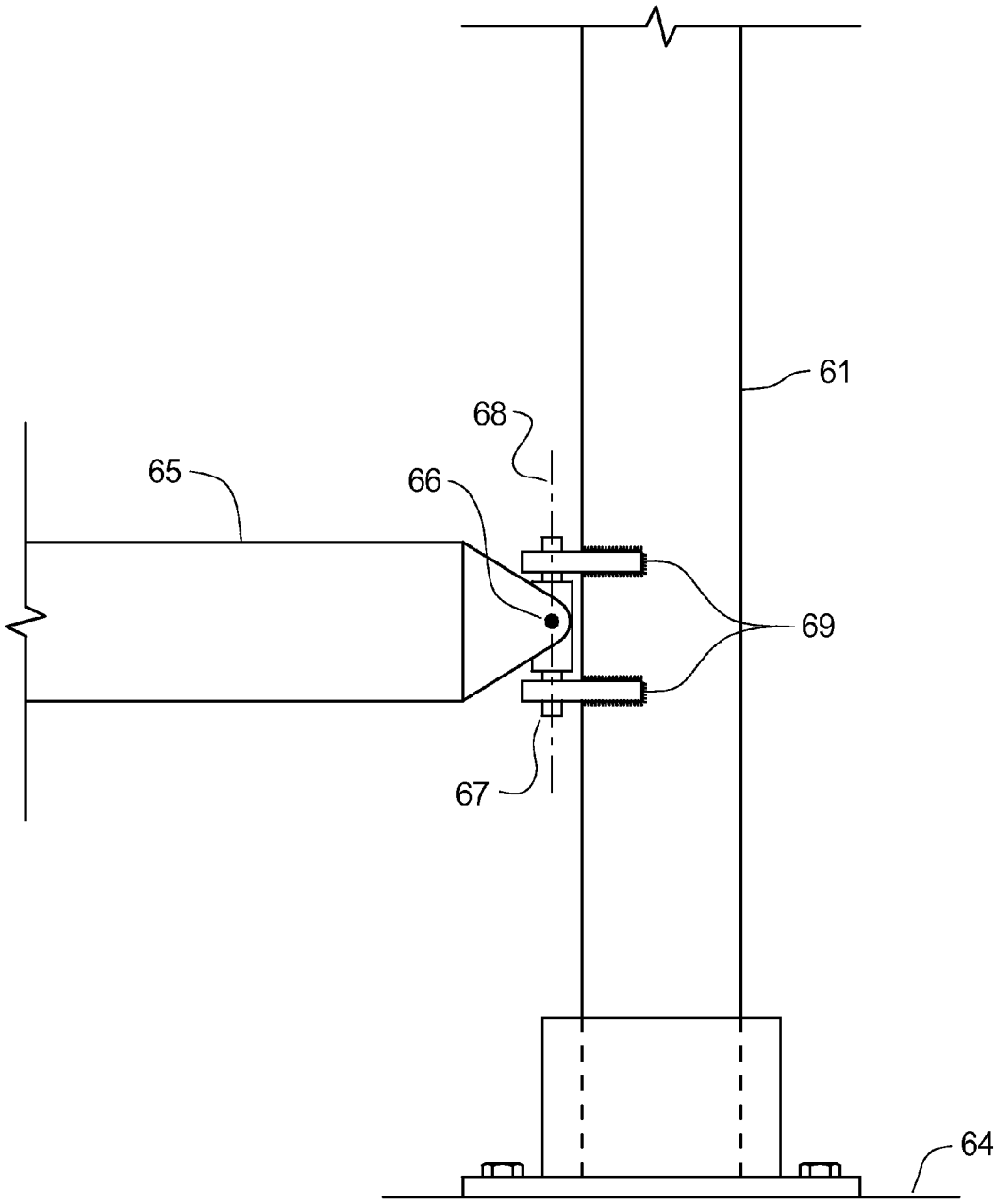
FIG. 6 PRIOR ART
FIG. 6 shows a side view of a conventional boom design as seen in the prior art.

FIG. 6 shows a side view of a conventional boom design where it is mounted on the main mast utilizing a universal joint. A vertical mast 61 is attached to a sailboat surface 64 by a bolting system or other attaching means. The boom 65 is connected to a horizontal pin 66 which is connected to a vertical shaft 67 which rotates about vertical axis 68. The vertical shaft 67 is attached to the vertical mast 61 utilizing supporting plates 69 which are welded to the vertical mast 61. As can be readily seen, the conventional boom may not be used as a type of lever for raising the main mast as it is very unstable, and it is mounted upwardly on the main mast itself. In this position, the boom will create large bending forces on the lower portion of the mast if it is used as part of a lever system to raise the main mast.

A rudder of the present invention functions similarly to pivoting or retracting rudders that are already known in the art. As may be appreciated by those skilled in sailing, a retractable rudder may have the advantage of being less expensive than wheel driven steering. In either case, the rudder of the present invention may be positioned or retracted for trailering and transport.

An important challenge with larger sailboats is the expense and difficulty launching and storing. With large sailboats of the past, it has been necessary to crane launch and permanently dock sailboats that are generally longer than approximately 30 feet. For example, sailboats in accordance with the present invention may have a configuration with a length of approximately 45 feet length overall and still be capable of being trailered behind a normal full size pick-up truck. Thus the present invention combines the advantages of small trailerable boats with the advantages of large, fast, safe, and capable sailboats.

Another advantage of large trailerable sailboats according to the present invention is that the mast may be located further aft, in comparison to common sailboat designs, allowing the fore deck to be opened up for better down-wind sailing.

The embodiments and examples set forth herein were presented in order to explain the present invention and its practical application, and to thereby enable those of ordinary skill in the art to make and use the invention. For example, while the advantages of the present invention are described in combination with large trailerable sailboats, it is to be understood that the invention is also directed toward smaller trailerable sailboats and will have similar desirable features.

While various embodiments of the present invention have been described, the invention may be modified and adapted to sailboats by those skilled in the art. Therefore, this invention is not limited to the description and figure shown herein, and includes all such embodiments, changes, and modifications that are encompassed by the scope of the claims.

I claim:

1. A trailerable sailboat comprising:

a. a pivoting mast connected to said trailerable sailboat at one end wherein said connected end of said pivoting mast is rotatable about a first axis, wherein said first axis is substantially horizontal and is oriented substantially perpendicular to said trailerable sailboat's lengthwise centerline, b. wherein said pivoting mast weighs at least 25 pounds, c. wherein said trailerable sailboat is dimensionally reduced by lowering said pivoting mast to a substantially horizontal position for transportation on overland public roadways, d. a plurality of shrouds, wherein said shrouds stabilize said pivoting mast motion about said first axis, wherein one end of each of said shrouds terminates substantially in line with said first axis, e. a boom which is attached to said trailerable sailboat at an attached end using a mechanical attachment, wherein said attached end of said boom is attached to said trailerable sailboat separately from said pivoting mast, f. wherein said mechanical attachment allows said attached end of said boom to rotate about a second axis which is substantially vertical and a third axis which is substantially horizontal, g. wherein said boom is used to move said pivoting mast between substantially horizontal and substantially vertical positions, h. wherein said boom is mechanically restrained to rotate only about said third axis when said boom is used to move said pivoting mast between substantially horizontal and substantially vertical positions, i. wherein said third axis is substantially parallel to said first axis when said boom is used to move said pivoting mast between substantially horizontal and substantially vertical positions, j. wherein said boom is used as a sailing boom for at least one sail on said pivoting mast, k. wherein said trailerable sailboat is ramp launchable free of the use of a lifting crane, and l. wherein said mechanical attachment incorporates a plurality of stabilizing clamps for the purpose of providing additional said mechanical restraining of said boom to rotate only about said third axis, wherein said stabilizing clamps operate between two positions:

i. a first position useful for normal sailing, wherein said stabilizing clamps provide no restriction of movement of said boom, and ii. a second position useful to stabilize the movement of said boom, wherein said stabilizing clamps allow said boom to substantially rotate only about said third axis.

2. The trailerable sailboat according to claim 1 wherein the moving of said pivoting mast to a substantially vertical position from a substantially horizontal position comprises:

a. positioning said boom so that said third axis is parallel to said first axis, b. raising said boom to a vertical position manually by pivoting said boom about said third axis, c. connecting the free end said boom to the free end of said pivoting mast by a first line, d. connecting the free end of said boom to a mechanical advantage device by use of said first line or by use of a second line, e. optionally connecting additional lines to said boom, f. mechanically restraining said boom temporarily to rotate only about said third axis, g. raising said pivoting mast to a substantially vertical position by use of said mechanical advantage device, and h. attaching and tensioning stabilizing lines to said pivoting mast to provide for operating said trailerable sailboat.

3. The trailerable sailboat according to claim 1 wherein the moving of said pivoting mast to a substantially horizontal position from a substantially vertical position comprises:

a. positioning said boom so that said third axis is parallel to said first axis, b. connecting the free end said boom to the free end of said pivoting mast by a first line, c. connecting the free end of said boom to a mechanical advantage device by use of said first line or by use of a second line, d. optionally connecting additional lines to said boom, e. mechanically restraining said boom temporarily to rotate only about said third axis, and f. lowering said pivoting mast to a substantially horizontal position by use of said mechanical advantage device.

4. The trailerable sailboat according to claim 1 wherein said pivoting mast and said boom are both mounted on top of said trailerable sailboat's cabin.

5. The trailerable sailboat according to claim 1 wherein a gooseneck trailer is used to transport said trailerable sailboat on said overland public roadways.

6. The trailerable sailboat according to claim 5 wherein said trailerable sailboat is situated on said gooseneck trailer for hauling so that said pivoting mast protrudes forward toward a vehicle which is used to transport said gooseneck trailer.

7. The trailerable sailboat according to claim 6 wherein said protrusion forward of said pivoting mast does not extend beyond the front of said vehicle.

8. The trailerable sailboat according to claim 1 wherein said dimensional reduction allows said trailerable sailboat to be hauled overland without a government hauling permit.

9. The trailerable sailboat according to claim 8 wherein said trailerable sailboat is between 30 to 45 feet long inclusive, less than or equal to 8.5 feet wide, and less than 13,000 pounds displacement.

10. A sailing boom attachment for a trailerable sailboat useful for stabilizing said sailing boom when used for moving a pivoting mast between horizontal and vertical positions that is additionally useful for allowing a normal sailing operation comprising:

a. a vertical axis that is oriented substantially vertical and substantially perpendicular relative to said trailerable sailboat's lengthwise centerline, b. wherein said sailing boom attachment is connected to said trailerable sailboat separately from said pivoting mast, c. wherein said sailing boom attachment allows said sailing boom to rotate about said vertical axis, d. a horizontal shaft that is incorporated into said sailing boom attachment, e. wherein said horizontal shaft is oriented substantially horizontal relative to said trailerable sailboat's lengthwise centerline, f. wherein said sailing boom pivots about said horizontal shaft, g. two stabilizing claims that are incorporated into said sailing boom attachment, h. wherein a stabilizing clamp is located substantially at each end of said horizontal shaft or within close proximity of each end of said horizontal shaft, i. wherein said stabilizing clamps operate between two positions:

I. a first position useful for normal sailing, wherein said stabilizing clamps provide no restriction of movement of said horizontal shaft, and II. a second position useful for said moving of said pivoting mast between said horizontal and vertical positions, wherein said stabilizing clamps contain the movement of said horizontal shaft by direct contact so that said horizontal shaft is substantially perpendicular to the lengthwise centerline of said trailerable sailboat, and j. wherein said sailing boom is used to move said pivoting mast between said horizontal and vertical positions by a connected tension line, whereby said second position of said stabilizing clamps provides improved stability of said sailing boom when said sailing boom is used to move said pivoting mast between said horizontal and vertical positions on said trailerable sailboat.

* * * * *